US006170237B1

(12) United States Patent
Wipf

(10) Patent No.: US 6,170,237 B1
(45) Date of Patent: Jan. 9, 2001

(54) PROCESS AND DEVICE FOR PACKAGING ELONGATE PRODUCTS AND PACKAGES PRODUCED THEREBY

(75) Inventor: Alfred Wipf, Jestetten (DE)

(73) Assignee: SIG Pack Systems AG, Beringen (CH)

( * ) Notice: Under 35 U.S.C. 154(b), the term of this patent shall be extended for 0 days.

(21) Appl. No.: 09/373,661

(22) Filed: Aug. 13, 1999

(30) Foreign Application Priority Data

Aug. 14, 1998 (CH) ..... 1679/98

(51) Int. Cl.[7] ..... B65B 11/00; B65B 11/50

(52) U.S. Cl. ..... 53/455; 53/252; 53/462; 53/550

(58) Field of Search ..... 53/455, 462, 450, 53/550, 251, 252, 374.4, 244, 255, 562, 375.9

(56) References Cited

U.S. PATENT DOCUMENTS 4,512,136 * 4/1985 Christine ..... 53/410
5,174,088 12/1992 Focke et al. ..... 53/431
5,941,052 * 8/1999 Evangelisti ..... 53/433
5,966,898 * 10/1999 Su ..... 53/133

* cited by examiner

*Primary Examiner*—Peter Vo
*Assistant Examiner*—Hemant M. Desai
(74) *Attorney, Agent, or Firm*—Venable; Gabor J. Kelemen; Leo J. Jennings

(57) ABSTRACT

A process and device for packaging elongate products where a packaging material is drawn from a supply in a transportation direction includes sealing around the elongate products longitudinally and transversely. The packaging material is delivered in the form of a partial tube having one open longitudinal side and one closed longitudinal side, and a width between the open longitudinal side and the closed longitudinal side. A plurality of first transverse seals are made across the partial tube, extending less than the width of the partial tube, to form a plurality of transverse pockets in the tube and the elongate products are inserted into the pockets. A plurality of second transverse seals are made to form a transverse sealing seam across the full width of the tube. A seal is made on the open longitudinal side of the partial tube to form a longitudinal sealing seam.

12 Claims, 1 Drawing Sheet

PROCESS AND DEVICE FOR PACKAGING ELONGATE PRODUCTS AND PACKAGES PRODUCED THEREBY

BACKGROUND OF THE INVENTION

From WO 96/23711 a device for packaging tampons is known. From a strip-like packaging sheet a tube is formed around a mandrel and the two edges of the sheet are sealed with a longitudinal sealing seam. The tube is then separated into individual pieces. The tube pieces are sealed at one end with a transverse sealing seam. The tampons are then placed in the tube pieces and the second end is sealed with a further transverse sealing seam.

Alternatively, bag forming, filling and sealing packaging machines are known. A packaging sheet is drawn from a supply and formed into a tube around the elongate products supplied in an evenly spaced manner extending longitudinally in the direction of transportation, the said sheet is sealed with a longitudinal sealing seam. Then, in a transverse sealing station transverse sealing seams are formed between the products and the tube is cut through in the middle of these transverse sealing seams. These bag forming, filling and sealing packaging machines operate in a more rational manner than the device described in WO 96/23711.

In the case of tampons a cord is provided hanging loose at one end. If the above-described bag forming, filling and sealing packaging machine were used to package tampons this cord could get into the longitudinal sealing seam, which would be undesirable. By reason of the long length of the tampons the packaging capacity of the machine would be relatively low.

SUMMARY OF THE INVENTION

It is the object of the present invention to provide a process and a device with which elongate products, particularly tampons, can be packaged in a rational manner.

DETAILED DESCRIPTION OF THE PREFERRED EMBODIMENTS

Figure 1:
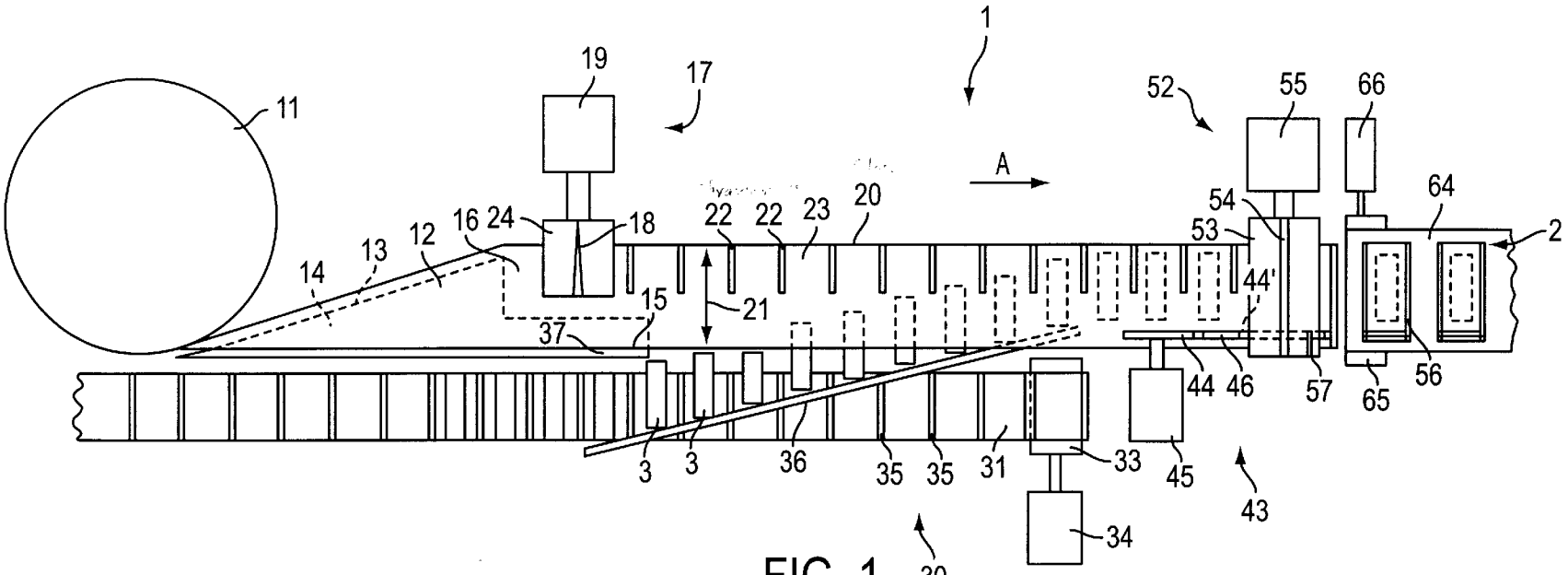
FIG. 1 is a schematic plan view of a device in accordance with the invention.

The illustrated device 1 serves to produce packages 2 (FIG. 2) containing a tampon 3 in a tube bag 4. The tampon 3 has a sheath 5 which is closed at the front in such a way as to form a portion of a spherical cap, in which sheath the actual tampon is contained. A tubular shaft 6 is inserted into the sheath 5 from behind. A cord 7 attached to the tampon protrudes loosely through the rear end of the shaft 6.

In the device 1 a packaging sheet strip 12 is drawn from a supply roll 11. The sheet can be, for example, a paper strip coated on one side or a thermoplastic sheet. The strip 12 is pulled with its longitudinal centre over a ridge 13—inclined to the direction of transportation—of a strut 14 so that it is folded along its longitudinal centre to form a tube 16 which is open on one long side 15. Downstream of the strut 14 a first transverse sealing station 17 is disposed with two cooperating sealing jaws 18 turning in opposite directions on opposite sides of the tube 16, which sealing jaws are driven by a motor 19. The transverse sealing jaws 18 extend from outside the folded edge 20 of the tube 16 over a part of the width 21 of the tube 16, preferably over less than half of this width 21. By means of the jaws 18 relatively short transverse sealing seams 22 are formed. By means of the seams 22 pockets 23 are formed in the tube 16. The jaws 18 are mounted in driving rollers 24 which pull the sheet 12 from the roll 11.

Next to the open long side 15 of the tube 16 extends a conveying device 30 for the tampons 3 conveyed with their longitudinal extension transverse to the direction of transportation A. The device 30 includes a conveyor belt 31, for example, a toothed belt, which is guided over a deflection roller 33. The roller 33 is driven by a motor 34. The upper side of the belt 31 extends somewhat below the horizontal middle plane of the tube 16. Low carriers 35 are attached to the belt 31 at regular intervals. The tampons 3 are conveyed on the belt 31 in each case between two adjacent carriers 35. Above the belt 31 a rail 36 is mounted, below which the carriers 35 pass through. The rail 36 converges in the direction of transportation A towards the longitudinal edges 15, 20 and engages at the downstream end between the two longitudinal edges 15 of the tube 16. This downstream end and an extension 37 on the strut 14, protruding beyond the rollers 24 in the direction of conveyance A hold the two longitudinal edges 15 of the tube 16 spaced apart in such a way that the rail 36 can push the tampons 3 into the pockets 23 as the belt 31 moves forwards. The downstream end of the rail 36 is disposed in the region of the roller 33.

Downstream of the rail 36 the two longitudinal edges 15 are sealed together in a longitudinal sealing station 43. The station 43 has two heated sealing jaws 44 in the form of a circular disc, which are pressed together, rotate in opposite directions and are driven by a motor 45. The jaws 44 form the longitudinal sealing seam 46. The peripheral speed of the jaws 44 is somewhat slower than that of the rollers 24 because the pockets 23 are widened in the transverse direction when the tampons 3 are pushed in. For the same reason the space between the carriers 35 is somewhat less than the space between the seams 22 immediately downstream of the station 17.

Downstream of the station 43 a second transverse sealing station 52 is disposed. This includes two rollers 53 driven in opposite directions and having radially protruding, cooperating sealing jaws 54. The rollers 53 are driven by a motor 55. The jaws 54 form transverse sealing seams 56 which extend over the entire width of the tube 16, coincide with the seams 22 and thus extend them at least to the longitudinal seam 46. The jaws 54 are evenly distributed over the periphery of the rollers 53. At least one of these jaws 54 of one roller 53 has a transverse separating blade (not shown) in the middle and parallel with the axis, which blade cuts through the formed transverse seam 56 in the longitudinal centre so that either individual packages 2 or groups of a plurality of packages 2 linked together are formed.

As an alternative to the illustrated embodiment the longitudinal sealing jaws 44 can also be integrated into the rollers 53, which is indicated in FIG. 1 with the jaw 44' drawn in broken lines. One roller 53 can also have a short blade 57 which is offset in the peripheral direction with respect to the jaws 54 and which cuts a tearing notch 58 in the longitudinal sealing seam 46 in each case between the seams 56 in order to make it possible to open the package 2 easily. Alternatively the longitudinal sealing seam 46 can be formed as a peeling seam. To this end the two longitudinal edges 15 of the tube 16 are somewhat laterally offset with respect to each other and the sealing seam 46 which in this case is weaker is offset somewhat inwards with respect to these longitudinal edges 15.

Figure 2:
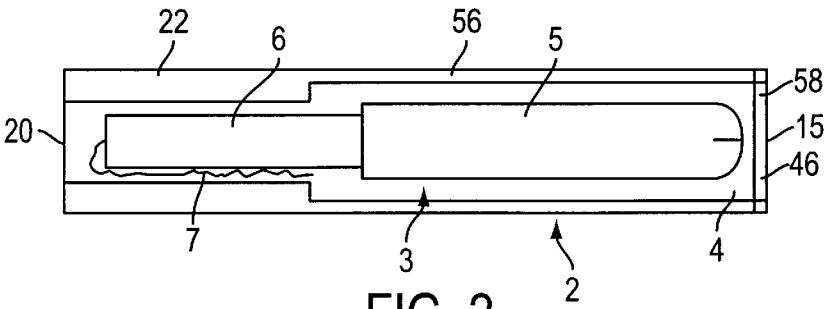
FIG. 2 is a plan view of a package.

Downstream of the station 52 the packages 2 or groups of packages are carried off by a conveyor belt 64. The belt 64 is guided over a deflecting roller 65 which is driven by a motor 66 at a peripheral speed which is somewhat greater than that of the jaws 54 so that intermediate spaces are formed between subsequent packages 2 or groups of packages. The jaws 18 can be wider than the jaws 54 so that the transverse sealing seams 22, 56 are stepped as shown in FIG. 2. This has, in particular, the advantage that the longitudinal centre of the seams 56 does not have to correspond exactly to the longitudinal centre of the seams 22 and that the bag 4 lies more closely against the product 3.

In a variation from the described embodiment the supply roll 11 can be formed from a half tube so that the strut 14 is not required.

By reason of the fact that in the described device the tampons 3 are inserted into the prefabricated pockets 23 with the thinner shaft 6 and the cord 7 protruding from the end thereof foremost, the cord 7 cannot become sealed into the sealing seam. In this way reliable packaging with a low rejection rate is achieved. By reason of the fact that the tampons 3 are packaged with their longitudinal extension transverse to the direction of transportation A the packaging capacity is considerably higher than packaging in the longitudinal direction for the same rate of withdrawal of the sheet strip 12. In addition, the air can easily escape from the package. The tube bags 4 provide better product protection than the current mechanically sealed packages. The width of the transverse seams 22, 56 can be minimised because no additional width is required in order to provide a tearing aid on the transverse seams 22 56 since the tearing aid, for example, the notch 58, is provided on the longitudinal seam 46. By means of the narrow transverse seams 22, 56 the consumption of packaging material is minimised and costs therefore reduced. The device is suitable for all current tampons without these having to be prepared beforehand, for example, without the cords 7 having to be fixed. Narrow packages are produced which minimise the space requirement for group packages in boxes.

What is claimed is:

1. A process for packaging elongate products wherein a packaging material is drawn from a supply in a transportation direction and is sealed around the elongate products longitudinally and transversely, comprising the steps of:

delivering the packaging material in the form of a partial tube having one open longitudinal side and one closed longitudinal side, and a width between the open longitudinal side and the closed longitudinal side;

making a plurality of first transverse seals across the partial tube, starting at the closed longitudinal side and extending less than the width of the partial tube, to form a plurality of transverse pockets in the partial tube;

inserting the elongate products into the transverse pockets;

making a plurality of second transverse seals, each second transverse seal continuing from respective ones of the first transverse seals to the open longitudinal side to form a transverse sealing seam across the full width of the partial tube; and sealing the open longitudinal side of the partial tube to form a longitudinal sealing seam, thereby forming a plurality of packages.

2. The method according to claim 1, wherein the step of delivering includes folding a sheet of the material to form the partial tube in the form of a generally flat partial tube.

3. The method according to claim 1, wherein the step of delivering includes pulling the material from a supply in the form of a half tube to form the partial tube.

4. The method according to claim 1, further comprising the step of separating at least one of the packages from an adjacent package, during the step of sealing the open longitudinal side of the tube.

5. The method according to claim 1, further comprising the step of separating at least one of the packages from an adjacent package, after the step of sealing the open longitudinal side of the tube.

6. The method according to claim 1, wherein the step of sealing the longitudinal side of the tube comprises providing a peeling seam.

7. The method according to claim 1, wherein the step of sealing the longitudinal side of the tube comprises providing a tearing notch.

8. A device for packaging elongate products wherein a packaging material is drawn from a supply in a transportation direction and is sealed around the elongate products longitudinally and transversely, comprising:

a supply station that receives a supply of the packaging material in the form of a partial tube having one open longitudinal side and one closed longitudinal side, and a width between the open longitudinal side and the closed longitudinal side;

a first transverse sealing station for making a plurality of first transverse seals across the partial tube, starting at the closed longitudinal side and extending less than the width of the partial tube, to form a plurality of transverse pockets in the partial tube;

a conveying device disposed laterally adjacent the open longitudinal side of the tube, which conveys the elongate products at regular intervals in the direction of transportation and inserts the elongate products into the pockets;

a second transverse sealing station for making a plurality of second transverse seals, each second transverse seal continuing from respective ones of the first transverse seals to the open longitudinal side to form a transverse sealing seam across the full width of the partial tube; and a longitudinal sealing station for sealing the open longitudinal side of the partial tube to form a longitudinal sealing seam extending in the transportation direction.

9. A device according to claim 8, wherein the second transverse sealing station is downstream in the transportation direction from the longitudinal sealing station.

10. A device according to claim 8, wherein the second transverse sealing station is located at a location of the longitudinal sealing station.

11. A device according to claim 8, further comprising a separation device for separating one of the packages from an adjacent package, after the step of sealing the open longitudinal side of the tube to form individual packages.

12. A device according to claim 8, further comprising a separation device for separating more than one of the packages from an adjacent package, after the step of sealing the open longitudinal side of the tube to form groups of packages.

* * * * *